US009091178B2

(12) United States Patent
Jahn

(10) Patent No.: US 9,091,178 B2
(45) Date of Patent: Jul. 28, 2015

(54) SEALING ARRANGEMENT

(75) Inventor: Ingo H J Jahn, West End (AU)

(73) Assignee: ROLLS-ROYCE PLC, London (GB)

( * ) Notice: Subject to any disclaimer, the term of this patent is extended or adjusted under 35 U.S.C. 154(b) by 556 days.

(21) Appl. No.: 13/536,135

(22) Filed: Jun. 28, 2012

(65) Prior Publication Data

US 2013/0034438 A1 Feb. 7, 2013

(30) Foreign Application Priority Data

Jul. 6, 2011 (GB) ..... 1111531.8

(51) Int. Cl.
*F01D 11/00* (2006.01)

(52) U.S. Cl.
CPC ..... *F01D 11/003* (2013.01)

(58) Field of Classification Search
CPC ..... F02D 11/003; F01D 11/003
USPC ..... 415/111, 112, 113, 171.1, 229, 230; 277/408, 500, 579, 580; 384/139, 143
See application file for complete search history.

(56) References Cited

U.S. PATENT DOCUMENTS

| | | | | |
|---|---|---|---|---|
| 6,132,168 | A * | 10/2000 | Kovaleski et al. | 415/113 |
| 2001/0004145 | A1 | 6/2001 | Wright et al. | |
| 2008/0089624 | A1* | 4/2008 | Gille et al. | 384/99 |
| 2008/0217861 | A1* | 9/2008 | Sei | 277/385 |
| 2009/0243222 | A1* | 10/2009 | Pisseloup | 277/422 |
| 2010/0164180 | A1 | 7/2010 | Short | |
| 2010/0213674 | A1 | 8/2010 | Garrison et al. | |

OTHER PUBLICATIONS

British Search Report issued in British Application No. GB 1111531.8 dated Nov. 1, 2011.

* cited by examiner

*Primary Examiner* — Liam McDowell
(74) *Attorney, Agent, or Firm* — Oliff PLC

(57) ABSTRACT

A sealing arrangement, for example for providing an inter-shaft seal between shafts of a gas turbine engine, includes an air-riding sealing ring disposed between runners. A buffer fluid, such as air, is conveyed to a buffer cavity through a passage in the sealing ring. The buffer air provides a positive pressure drop along fluid-riding gaps, preventing leakage across the sealing arrangement. The sealing ring may be a split carbon ring, and measures may be provided to minimize leakage of buffer air at the split.

19 Claims, 3 Drawing Sheets

SEALING ARRANGEMENT

This invention relates to a sealing arrangement, and is particularly, although not exclusively, concerned with a sealing arrangement in a gas turbine engine.

BACKGROUND

It is frequently necessary to provide a seal between two rotating components, for example internal shafts and rotors of gas turbine engines. It is well known to use labyrinth seals in such applications. However, labyrinth seals allow significant leakage, which gets worse with time.

More recently, air-riding seals have been developed, for example as disclosed in US2010/0213674. Such a seal comprises a sealing ring, for example of carbon, which is mounted on one of the components so as to be rotationally fixed but axially displaceable. The sealing ring rotates next to a runner mounted on the other of the components. In operation, there is a small axial gap between confronting radial surfaces of the sealing ring and the runner, and one or both of the radial surfaces is profiled, such that, when relative rotation occurs between the components, aerodynamic lift is generated by the film of air in the axial gap between the radial surfaces to prevent them from coming into contact with one another.

Air-riding seals are designed in such a way that the width of the axial gaps is not affected by centrifugal effects or thermal growth. In the absence of contact between the sealing ring and the runner, wear is eliminated except at very low relative speeds. In a previously proposed sealing arrangement, a carbon sealing ring is disposed between two profiled runners so that an air-riding effect is achieved on both sides of the carbon ring. This causes the carbon ring to be centralised between the runners, maintaining a good seal. The carbon ring is a split ring and is therefore radially resilient to enable it to maintain contact with the component on which it is mounted. The split in the ring provides a route for leakage across the seal and in addition some leakage can occur through the air-riding gap between the carbon ring and the runners on each side. Apart from the loss of efficiency which can result from such leakage, in some applications hot gas can leak past the seal into an oil environment, creating a fire risk. Alternatively, oil leaking past the seal can result in oil loss.

SUMMARY

According to the present invention there is provided a sealing arrangement between first and second components which are rotatable relatively to each other, the sealing arrangement comprising a sealing ring rotationally secured to the first component and disposed between a pair of runners rotationally secured to the second component to define fluid riding gaps between the sealing ring and the runners, and to define a buffer cavity between the sealing ring, the runners and the second component, the buffer cavity communicating with a source of buffer fluid through a port in the first or second component.

When employed in a gas turbine engine, the fluid in the fluid riding gaps and in the buffer cavity may be air, in which case the sealing arrangement is an air-riding sealing arrangement.

The sealing ring may be axially displaceable with respect to the first component. This enables the sealing ring to remain centred between the runners in the event of axial variations in position between the first and second components. The sealing ring may be rotationally secured to the first component by frictional engagement between the sealing ring and the first component. For example, the sealing ring may have at least one circumferential split so that the sealing ring is radially resilient and can expand or contract to conform to the first component.

The sealing ring may have a passage extending from a surface of the sealing ring adjacent the first component and communicating with the buffer cavity.

The passage in the sealing ring may open directly into the buffer cavity. The passage may extend from a recess in the surface of the sealing ring adjacent the first component. The recess may comprise a circumferential channel defined by circumferential lands at opposite axial ends of the sealing ring. Where the sealing ring is a split ring, axial lands may extend axially across the sealing ring adjacent the split in the sealing ring to prevent direct communication between the channel and the split in the sealing ring. In order to restrict leakage across the sealing ring through the split, the circumferential end of the sealing ring on one side of the split may have a projection which is disposed in a notch in the circumferential end on the other side of the split.

A flexible closure means may extend across the split to prevent flow from the recess across the lands at the split.

The port may be provided in the first component, and may communicate with the passage.

A face of the sealing ring defining the buffer cavity may be profiled to direct flow preferentially to one or other of the fluid riding gaps, or to exert an axial pressure force on the sealing ring. For example, the face of the sealing ring defining the buffer cavity may be axially stepped so as to define regions of the buffer cavity adjacent the fluid riding gaps which are of different radial thickness. The passage may open into the region of greater radial thickness.

Alternatively, the passage in the sealing ring may open into at least one of the fluid riding gaps.

The port may open into the recess, in which case the recess may have an axial extent greater than that of the port, so that the port remains exposed to the recess despite axial displacement between the sealing ring and the first component.

In an alternative embodiment, the port may be provided in the second component, and may open into the buffer cavity.

The first and second components may comprise rotatable components, such as rotors or shafts of a gas turbine engine.

The present invention also provides a gas turbine engine having a sealing arrangement as defined above.

BRIEF DESCRIPTION OF THE DRAWINGS

For a better understanding of the present invention, and to show more clearly how it may be carried into effect, reference will now be made, by way of example, to the accompanying drawings, in which:—

DETAILED DESCRIPTION OF THE EMBODIMENTS

Figure 1:
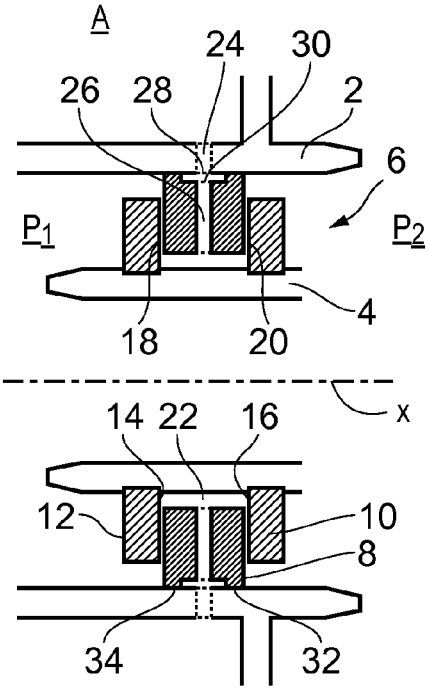
FIG. 1 is a schematic sectional view of a sealing arrangement in a gas turbine engine.

FIG. 1 shows first and second components 2, 4 in the form of internal shafts of a gas turbine engine. The shafts 2 and 4 are rotatable about a common nominal axis X.

A sealing arrangement 6 provides an intershaft seal between the shafts 2 and 4 to prevent flow between regions $P_1$ and $P_2$ which are at different pressures. The sealing arrangement 6 comprises a sealing ring 8 and a pair of runners 10, 12 on opposite sides of the sealing ring 8. The sealing ring 8 is made from carbon in the form of graphite. However, alternative materials, such as ceramics or other materials, may be employed. Ceramic materials may be used in high temperature applications, in which graphite may oxidise. The runners 10, 12 may be made from a suitable aerospace alloy. On the radial surfaces 14, 16 facing towards the sealing ring 8, the runners 10, 12 are profiled so that, when the sealing ring 8 rotates relatively to the runners 10, 12, aerodynamic lift is generated in the gaps 18, 20 between the sealing ring 8 and the runners 10, 12 so as to lift the sealing ring 8 away from the runners 10, 12 and centre it between them. The profiling may take the form of Rayleigh steps or radial grooves.

Figure 5:
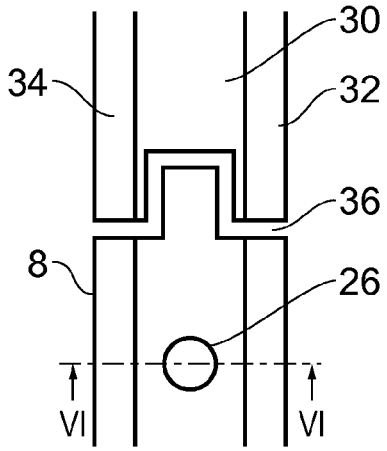
FIG. 5 is a fragmentary view of a sealing ring of the sealing arrangement of FIG. 1.

The runners 10, 12 are located rigidly with respect to the second shaft 4 and so rotate and move axially with that shaft. The sealing ring 8 is a split ring, as shown in FIG. 5, and is consequently radially resilient. It is radially compressed against its resilience to fit within the first shaft 2 and is thus frictionally engaged with the inner surface of the first shaft 2. The frictional engagement is such that, in normal operation, the sealing ring 8 rotates with the first shaft 2, but it is axially displaceable, against friction, with respect to the first shaft 2. Consequently, any relative axial displacement between the first and second shafts 2, 4 causes displacement of the sealing ring 8 along the first shaft 2, so that it remains between the runners 10, 12.

A buffer cavity 22 is defined between the sealing ring 8, the runners 10, 12 and the second shaft 4. Air under pressure from a region A is supplied to the buffer cavity 22 through openings 24 in the shaft 2 and a circumferential array of passages 26 in the sealing ring 8.

Figure 6:
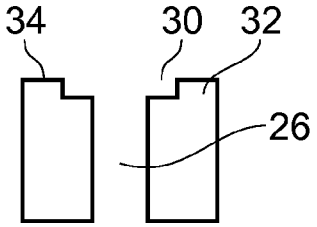
FIG. 6 is a sectional view taken on the line VI-VI in FIG. 5.

The openings 24 open at respective ports 28 into a recess 30 in the outer cylindrical surface of the sealing ring 8. The passages 26 extend from the recess 30 to the buffer cavity 22. As seen in FIGS. 5 and 6, the recess 30 is in the form of a channel disposed between raised circumferential lands 32, 34 which contact the inner surface of the first shaft 2.

FIG. 5 also shows the split 36 in the sealing ring 8. As shown in FIG. 5, the circumferential end of the sealing ring 8 on one side of the split 36 has a notch in which sits a projection on the other circumferential end of the sealing ring 8. The cooperating notch and projection form a labyrinth seal restricting flow between the regions P1 and P2 through the split 36.

In operation, when the shafts 2 and 4 rotate relatively to each other, the aerodynamic lift generated in the gaps 18, 20 causes the sealing ring 8 to be supported between the runners 10, 12. Buffer fluid in the form of air from the region A is supplied through the channel 30 and the passages 26 to the buffer cavity 22 and then passes through the gaps 18, 20 to the regions $P_1$ and $P_2$. This buffer air thus prevents any flow from the regions $P_1$ and $P_2$ into the gaps 18, 20 and so prevents leakage across the sealing arrangement 6.

In addition, buffer air penetrates into the split 36 and flows outwardly to each side, so, again, preventing flow from either of the regions $P_1$ and $P_2$ through the split 36.

The sealing ring 8 is an interference fit within the first shaft 2, so preventing any leakage past the interface between the sealing ring 8 and the first shaft 2.

In the event that the first shaft 2 changes diameter as a result of thermal or centrifugal growth or shrinkage, the resilience of the sealing ring 8 will accommodate this so that the sealing ring 8 remains in contact, over its entire circumference, with the first shaft 2.

In the event of axial relative displacement between the shafts 2 and 4, the sealing ring 8 is displaced axially along the first shaft 2 by its cooperation with the runners 10, 12, while remaining supported on the air films generated in the gaps 18, 20. The channel 30 is of sufficient width to remain over the ports 28 in all expected axial positions of the sealing ring 8 with respect to the first shaft 2.

In the embodiment shown in FIG. 1, the passages 26 open directly into the buffer cavity 22. Consequently, if the regions $P_1$ and $P_2$ are at different pressures, the pressure drop between the buffer cavity 22 and the region $P_1$ will be different from that between the buffer cavity 22 and the region $P_2$. This will cause different flow rates through the respective gaps 18 and 20. This can be mitigated by biasing the flow of buffer air from the buffer cavity 22 to flow preferentially through one or the other of the gaps 18, 20. For example, as shown in FIG. 2, the passages 26 may open into one of the gaps 18, 20 (the gap 20 as shown in FIG. 2) so that the leakage through the gaps 18, 20 can be equalised, at least approximately.

Figure 3:
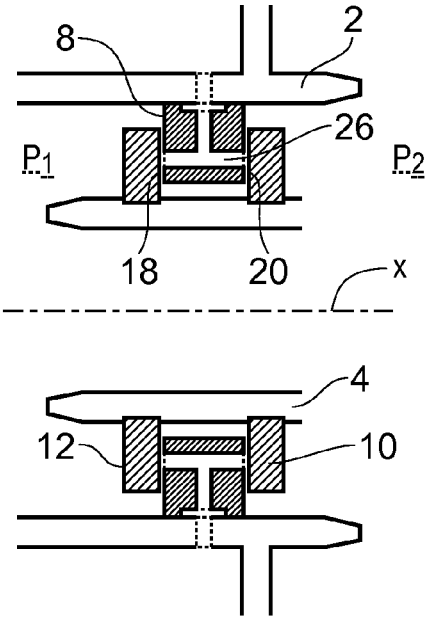

As shown in FIG. 3, the passages 26 can have the form of a "T" with branches extending to both of the gaps 18, 20. This configuration aids the air-riding performance of the sealing arrangement. The branches of the passages 26 can be of different diameter, in order to bias the buffer air flow preferentially to one gap 18, 20 or the other.

Figure 4:
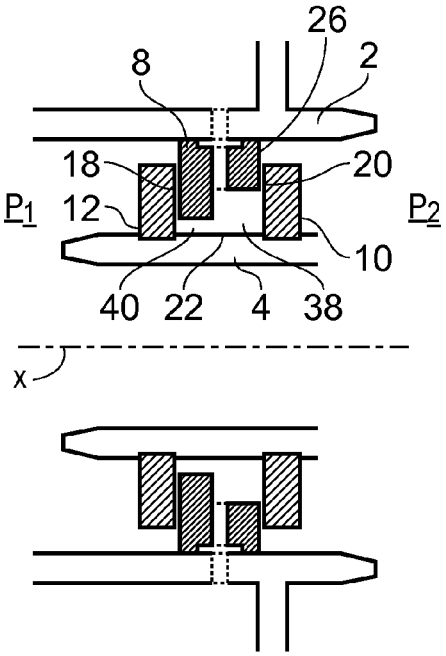

FIG. 4 shows an alternative configuration for biasing buffer fluid to one or the other of the gaps 18, 20. In the variant of FIG. 4, the sealing ring 8 is axially stepped at its surface which defines the buffer cavity 22. Consequently, the region 38 of the buffer cavity 22 nearer the runner 10 has a larger radial dimension than the region 40 nearer the runner 12. The passage 26 opens into the region 38 with the larger radial thickness, and flow will thus pass preferentially to the gap 20 rather than the gap 18. Consequently, the pressure drop from the exit of each passage 26 to the region $P_2$ will be lower than that from the exit of each passage 26 to the region $P_1$ with the result that the flow through the gaps 18, 20 can be approximately equalised even if the pressure $P_2$ is greater than the pressure $P_1$.

Figure 2:
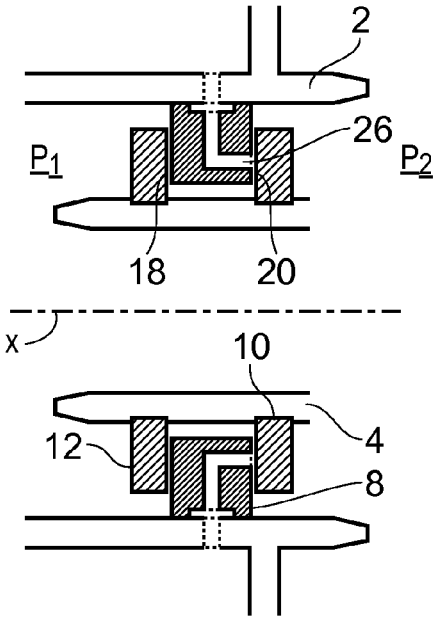
FIGS. 2 to 4 correspond to FIG. 1 but show variants of the sealing arrangement.

Another effect of the arrangements shown in FIGS. 2 to 4 is the application of an axial pressure force to the sealing ring 8. For example, in the embodiment of FIG. 4, buffer air in the buffer cavity 22 will exert a force on the sealing ring 8 to the left at the step between the regions 38 and 40. This force can be employed to balance or offset a net static axial force in the opposite direction resulting from the pressure difference at $P_1$ and $P_2$.

Figure 7:
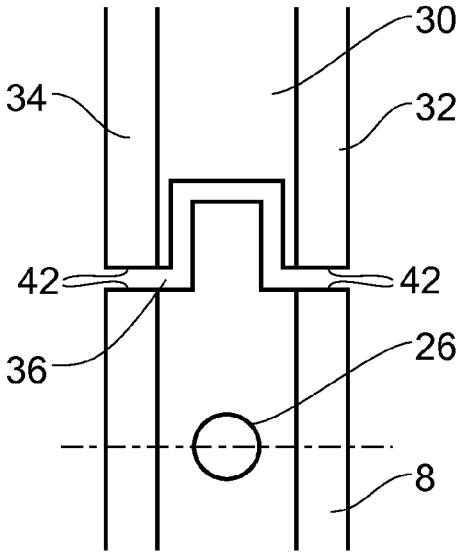
FIG. 7 corresponds to FIG. 5 but shows an additional feature.

In the embodiment shown in FIGS. 5 and 6, the channel 30 extends across the split 36, enabling buffer fluid to flow through the split 36 to the buffer cavity 22. This can desirably increase the flow of buffer fluid to the buffer cavity 22 and can also result in buffer fluid flowing laterally from the split 36 into the regions $P_1$ and $P_2$, so preventing leakage between these regions through the split 36. However, this additional flow of buffer fluid can be wasteful in a gas turbine engine. FIG. 7 shows a modification in which flow of buffer fluid to the regions $P_1$ and $P_2$ at the split 36 is prevented by means of flexible membranes 42 which extend between the ends of the lands 32, 34 on opposite sides of the split 36.

Figure 8:
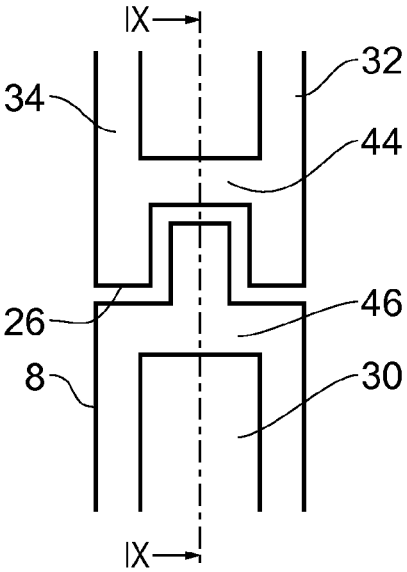
FIG. 8 corresponds to FIG. 5 but shows an alternative sealing ring.
Figure 9:
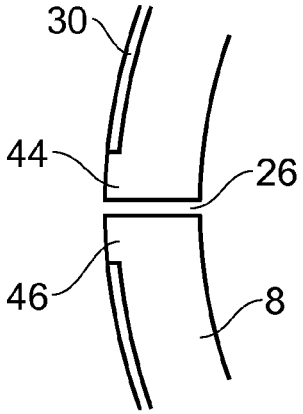
FIG. 9 is a sectional view taken on the line IX-IX in FIG. 8.

An alternative configuration for preventing flow of buffer fluid from the channel 30 to the split 36 is shown in FIGS. 8 and 9. In this embodiment, the circumferential lands 32, 34 are interconnected at the split 36 by transverse, or axial, lands 44, 46 which contact the inner surface of the shaft 2 to isolate the channel 30 from the split 36.

Figure 10:
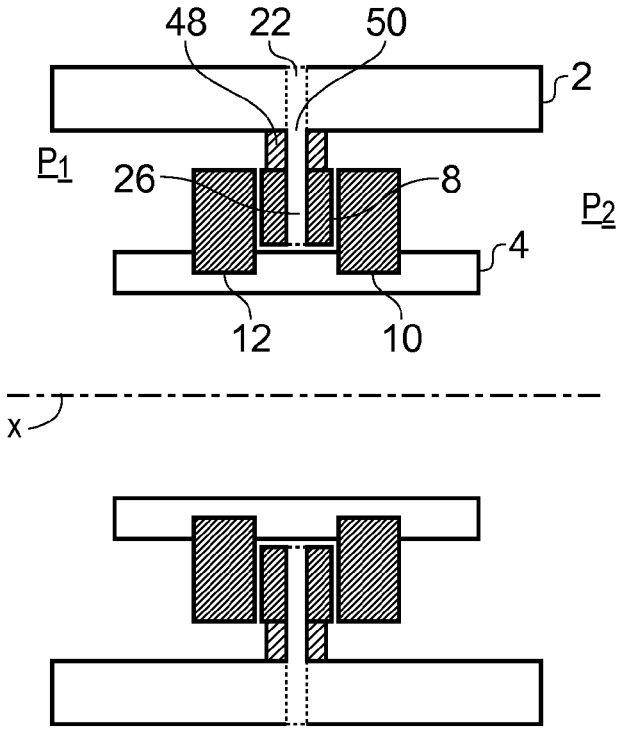
FIG. 10 corresponds to FIG. 1 but shows an alternative sealing arrangement.

In the embodiments of FIGS. 1 to 9, the sealing ring 8 is in direct frictional contact with the inner surface of the shaft 2. An alternative embodiment is shown in FIG. 10, in which the sealing ring 8 is, instead, supported on the first shaft 2 by an elastic ring 48. The elastic ring 48 may comprise a metal bellows or similar flexible structure, or may comprise one or more membranes made from an elastic material. Each passage 26 of the sealing ring 8 has an extension 50 which passes through the elastic ring 48 to meet the opening 24 in the first shaft 2.

The elastic ring 48 is sufficiently flexible to enable the sealing ring 8 to move axially to take up a position centrally between the runners 10, 12 as the shafts 2 and 4 move axially with respect to each other. The elastic ring 48 provides a perfect seal between the sealing ring 8 and the first shaft 2, so avoiding any leakage between the regions $P_1$ and $P_2$ between the sealing ring 8 and the first shaft 8.

Figure 11:
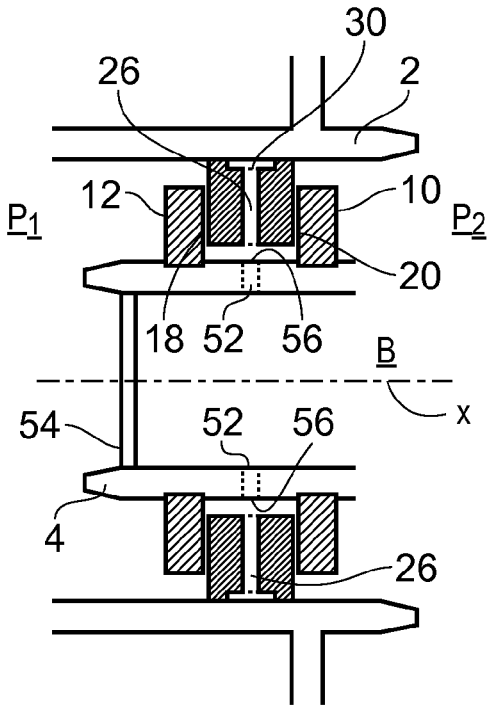
FIG. 11 corresponds to FIG. 1 but shows a further alternative sealing arrangement.

FIG. 11 shows an embodiment similar to that of FIG. 1. However, in the embodiment of FIG. 11, there are no openings 24 in the first shaft 2. Instead, there are openings 52 in the second shaft 4 which open at ports 56 directly into the buffer cavity 22. The interior B of the second shaft 4 is isolated from the region $P_1$ by a partition 54.

In operation, buffer air is supplied along the second shaft 4 and enters the buffer cavity 22 through the openings 52. The buffer air flows into the gaps 18, 20 to provide aerodynamic lift and to block the gaps 18, 20 against flow from the regions $P_1$ and $P_2$. Buffer air also flows through the passages 26 to the recess 30 to prevent flow into the recess 30 from the regions $P_1$ and $P_2$ over the lands 32, 34. Also, buffer air flows outwardly through the split 36 (not shown in FIG. 11) to prevent flow between the regions $P_1$ and $P_2$ through the split 36.

The sealing arrangements described above provide adequate sealing between the regions $P_1$ and $P_2$ despite relative axial displacement and differential radial growth or shrinkage between the shafts 2 and 4. When the buffer fluid is air, the air-riding nature of the sealing arrangement means that there is no contact between the sealing ring 8 and the runners 10, 12 when the shafts 2 and 4 rotate relatively to each other with a sufficient speed differential. This applies whether both shafts are rotating, either in the same direction or in opposite directions, or whether one shaft is rotating and the other is stationary. When the speed difference between the shafts is small or zero, the aerodynamic lift generated in the gaps 18, 20 breaks down, and direct contact may be made between the sealing ring 8 and one or the other of the runners 10, 12. Thus, when the sealing ring is used in a gas turbine engine, rubbing contact will occur during engine start-up and shut-down, and under some low speed transient conditions. Wear under these circumstances can be minimised by making the sealing ring and/or the runners 10, 12 from appropriate materials, and in particular if the sealing ring 8 is made from a self-lubricating material such as carbon.

Although the sealing ring 8 has been described as having a single split 36, it is possible for the sealing ring 8 to be a segmented ring made up of two or more suitably interconnected segments.

When employed in a gas turbine engine, the sealing arrangement 6 may be positioned to separate a region (for example $P_1$) occupied by air containing an oil mist from a region (for example $P_2$) containing uncontaminated air. The buffer fluid may be air drawn from a compressor stage of the engine. In other applications, one or both of the regions $P_1$ and $P_2$ could contain liquids, or gases other than air. The buffer fluid could also be a liquid, and such a seal could be employed to prevent leakage from a high pressure liquid region to a lower pressure gas region. The buffer fluid need not be the same as the gas or liquid in the regions $P_1$ and $P_2$. For example, the sealing arrangement 6 could be employed to prevent mixing of two gases occupying the regions $P_1$ and $P_2$, for example where one of the gases is poisonous or explosive. The buffer fluid may then be a third gas which can be safely mixed with the two gases to be separated. Furthermore, by employing biasing geometry such as shown in FIGS. 2 to 4, the sealing arrangement could be configured so that substantially all of the buffer gas leaks to one of the regions $P_1$ and $P_2$.

Embodiments in accordance with the present invention provide a fluid-riding sealing arrangement, and in particular an air-riding sealing arrangement, providing an integral buffer fluid arrangement which eliminates, or at least substantially restricts, leakage across the sealing arrangement. The sealing arrangement may be of a compact form, of simple construction and lightweight. Buffer air consumption can be kept low, so improving overall engine efficiency. The sealing arrangement remains effective despite significant relative axial displacement between the components.

The invention claimed is:

1. A sealing arrangement between first and second components which are rotatable relatively to each other, the sealing arrangement comprising a sealing ring rotationally secured to the first component and disposed between a pair of runners rotationally secured to the second component to define fluid riding gaps between the sealing ring and the runners, and to define a buffer cavity between the sealing ring, the runners and the second component, the buffer cavity communicating with a source of buffer fluid through a port in the first or second component; wherein the sealing ring has a passage extending from a surface of the sealing ring adjacent the first component and communicating with the buffer cavity, and the passage extends from a recess in the surface of the sealing ring adjacent the first component.

2. A sealing arrangement as claimed in claim 1, in which the sealing ring is axially displaceable with respect to the first component.

3. A sealing arrangement as claimed in claim 1, in which the sealing ring is rotationally secured to the first component by frictional engagement between the sealing ring and the first component.

4. A sealing arrangement as claimed in claim 1, in which the sealing ring has at least one circumferential split, whereby the sealing ring is radially resilient.

5. A sealing arrangement as claimed in claim 1, in which the recess comprises a circumferential channel, defined between circumferential lands at opposite axial ends of the sealing ring.

6. A sealing arrangement as claimed in claim 5, in which the sealing ring has at least one circumferential split, whereby the sealing ring is radially resilient, and axial lands extend axially across the sealing ring between the circumferential lands adjacent the split in the sealing ring.

7. A sealing arrangement as claimed in claim 1, in which the port is provided in the second component and opens into the buffer cavity.

8. A sealing arrangement as claimed in claim 1, in which the rotatable components are shafts in a gas turbine engine.

9. A gas turbine engine provided with a sealing arrangement in accordance with claim 1.

10. A sealing arrangement as claimed in claim 1, in which the port is provided in the first component and communicates with the passage.

11. A sealing arrangement between first and second components which are rotatable relatively to each other, the sealing arrangement comprising a sealing ring rotationally secured to the first component and disposed between a pair of runners rotationally secured to the second component to define fluid riding gaps between the sealing ring and the runners, and to define a buffer cavity between the sealing ring, the runners and the second component, the buffer cavity communicating with a source of buffer fluid through a port in the first or second component; wherein the sealing ring has a passage extending from a surface of the sealing ring adjacent the first component and communicating with the buffer cavity, and the port is provided in the first component and communicates with the passage.

12. A sealing arrangement as claimed in claim 11, in which a face of the sealing ring defining the buffer cavity is profiled to direct flow preferentially to one of the fluid riding gaps.

13. A sealing arrangement as claimed in claim 12, in which the face of the sealing ring defining the buffer cavity is axially stepped to define regions of the buffer cavity adjacent the fluid riding gaps which are of different radial thickness from each other.

14. A sealing arrangement as claimed in claim 11, in which the passage opens into at least one of the fluid riding gaps.

15. A sealing arrangement as claimed in claim 11, in which the sealing ring is axially displaceable with respect to the first component.

16. A sealing arrangement as claimed in claim 11, in which the sealing ring is rotationally secured to the first component by frictional engagement between the sealing ring and the first component.

17. A sealing arrangement as claimed in claim 11, in which the sealing ring has at least one circumferential split, whereby the sealing ring is radially resilient.

18. A sealing arrangement as claimed in claim 11, in which the rotatable components are shafts in a gas turbine engine.

19. A gas turbine engine provided with a sealing arrangement in accordance with claim 11.

* * * * *